United States Patent [19]

Sittmann

[11] 3,947,053

[45] Mar. 30, 1976

[54] RETAINING MECHANISM FOR SAFETY SKI BINDINGS

[75] Inventor: Brigitte Sittmann, Stuttgart, Germany

[73] Assignee: Vereinigte Baubeschlagfabriken Gretsch & Co., Leonberg, Germany

[22] Filed: May 24, 1974

[21] Appl. No.: 473,211

[30] Foreign Application Priority Data

May 25, 1973 Germany ..... 7319703[U]

[52] U.S. Cl. ..... 280/11.35 K; 280/11.35 T

[51] Int. Cl.[2] ..... A63C 9/08

[58] Field of Search 280/11.35 T, 11.35 K, 11.35 Y, 280/11.35 D, 11.35 E, 11.35 A, 11.35 B, 11.35 C, 11.35 R

[56] References Cited

UNITED STATES PATENTS

| | | | |
|---|---|---|---|
| 2,788,781 | 4/1957 | Emerson | 280/11.35 T |
| 3,361,434 | 1/1968 | Scheib | 280/11.35 S |
| 3,410,568 | 11/1968 | Wiley | 280/11.35 K |
| 3,782,743 | 1/1974 | Sittmann | 280/11.35 T |

FOREIGN PATENTS OR APPLICATIONS

| | | | |
|---|---|---|---|
| 1,499,960 | 9/1967 | France | 280/11.35 T |
| 1,905,440 | 11/1969 | Germany | 280/11.35 T |

*Primary Examiner*—M. H. Wood, Jr.
*Assistant Examiner*—Milton L. Smith
*Attorney, Agent, or Firm*—Craig & Antonelli

[57] ABSTRACT

A retaining mechanism for safety ski bindings with a detent member that is under the effect of a detent spring and engages into a counter-detent constructed as a recess; the detent member is thereby adapted to be forced out of the counter-detent by overcoming the detent spring force when vertical forces act on the retaining member retaining the boot; the counter-detent which is delimited on different sides by differently shaped raised portions is adapted to be rotatably adjusted and can be fixed in a selected rotary position.

22 Claims, 3 Drawing Figures

RETAINING MECHANISM FOR SAFETY SKI BINDINGS

The present invention relates to a retaining or hold-down mechanism for safety ski bindings with a detent member, for example, a detent piston, a detent ball or the like, under the effect of a detent spring, which engages in a counter-detent constructed especially as a recess, whereby for purposes of releasing the binding the detent member can be forced out of the counter-detent over a raised portion delimiting the counter-detent while overcoming the detent spring force in the presence of strong vertical forces acting from the ski boot on the hold-down or retaining member of the retaining mechanism holding-down the boot, for example, during backward falls or forward falls or twisting falls.

It is known to arrange a part which includes the counter-detent, in an interchangeable manner, so that the inclined surfaces delimiting the counter-detent which serve the purpose of elastically or yieldingly forcing back the detent member during the release, may receive different inclinations with respect to a plane that is disposed perpendicular to the effective direction of action of the detent spring.

It is furthermore known to arrange the inclined surfaces delimiting the counter-detent in a vertical plane with a different angle than the inclined surfaces provided at the same time in the horizontal direction. For instance, a greater release stiffness for a release in the vertical direction, for example, during a forward fall, can be effected thereby than in the horizontal direction, for example, during a twisting fall.

However, it is frequently desirable to adjust one and the same mechanism to different release or disengaging stiffnesses of the retaining mechanism without the need to carry along for this purposes a further part for the interchange of the counter-detent.

The present invention is concerned with the task to satisfy these requirements with the simplest possible means. Accordingly, the present invention essentially consists in that the counter-detent is delimited on different sides by differently shaped raised portions and the counter-detent support which includes the counter-detent with the raised portions is rotatably arranged about an axis in or approximately in the direction of the detent engagement and is adapted to be secured or fixed in the preselected rotational position.

It is therefore merely necessary for changing the detent engagement to adjust the counter-detent member, after unlocking or releasing the same, into another or into one of its other positions and to subsequently lock or secure the same again. The shifting can be realized in a simple and rapid manner. An additional loose spare-part is not necessary.

As such, any desired number of detents distributed about the axis of rotation may be provided. However, if the detent mechanism is simultaneously to serve the purpose to assure a release in case of a forward fall or a backward fall as well as simultaneously also in case of a twisting fall, i.e., in both lateral directions, preferably such rotatable counter-detents are used in which the lateral raised portions have different detent or release actions only on two mutually oppositely disposed sides whereas the raised portions offset with respect thereto by 90°, insofar as present, are constructed in the same manner or approximately in the same manner in order that in case of a shifting of the counter-detent, the detent mechanism is suitable and effective in the same manner for a twisting fall toward the right as also for a twisting fall toward the left.

The constructions of the detents to be selectively adjusted may be different as regards the detent engagement and also, for example, as regards the inclined surface, along which the detent member is guided for the disengagement.

Accordingly, it is an object of the present invention to provide a retaining mechanism for safety ski bindings which avoids by simple means the aforementioned shortcomings and drawbacks encountered in the prior art.

Another object of the present invention resides in a retaining mechanism for safety ski bindings in which the release stiffness can be readily changed without the need of additional spare parts.

A further object of the present invention resides in a safety ski binding of the type described above which is simple in construction yet permits a simple and rapid adjustment of the release force required for the release of the binding as a result of a fall in a predetermined direction.

These and further objects, features and advantages of the present invention will become more apparent from the following description when taken in connection with the accompanying drawing which shows, for purposes of illustration only, one embodiment in accordance with the present invention, and wherein.

Figure 1:
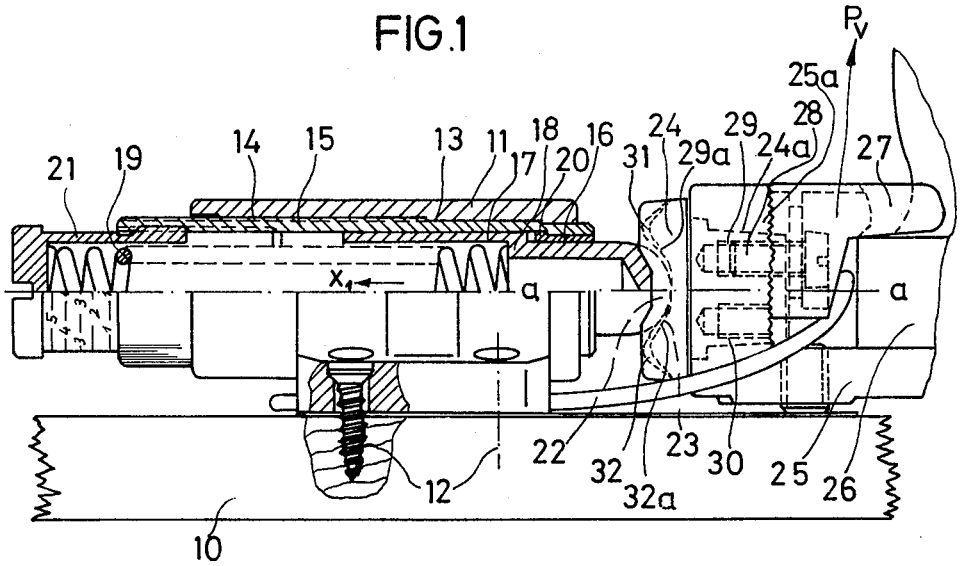
FIG. 1 is a side elevational view, partly in cross section, of the arrangement of a front jaw on a ski with an associated counter-detent of a ski binding member, for example, a sole plate of a safety ski binding in accordance with the present invention.

Referring now to the drawing wherein like reference numerals are used throughout the two views to designate like parts, a front jaw 11 is secured on the ski 10 by means of screws 12. A threaded sleeve 15 is threadably arranged in a bore 13 of the front jaw 11 by means of an internal thread 14. A piston-like detent member 17 which is offset step-like in its diameter by a shoulder 18, as well as a detent spring 19, are accommodated in the threaded sleeve 15. A slide bush 16 is interposed between the threaded sleeve 15 and the piston-like detent member 17. The spring 19 seeks to force the detent member 17 by means of the offset 18 against an abutment shoulder 20 on the slide bush 16 axially supported in the threaded sleeve 15 and is supported, on the other hand, against an adjustable spring abutment 21 which is adjustable in the threaded sleeve 15 by screw action for purposes of controlling the spring stress.

The detent member 17 is in engagement by means of its rounded-off head portion 22 with a counter-detent 23 formed by a recess in a counter-detent member 24 which is rotatably supported about a horizontal longitudinal axis *a—a* by means of a pin portion 24*a* in a support bracket 25*a* on a binding part 25, for example, a sole plate of any conventional construction.

For example, the boot is adapted to be securely clamped together with the sole plate 25, e.g., by a retaining or hold-down jaw 27 overlapping the boot sole 26 and by a further clamping member of any conventional construction overlapping the heel (not shown) whereas the sole plate 25 itself is additionally retained by detent action on the ski preferably at its rear end by a hold-down or retaining mechanism of any known type, for example, in the manner of an automatic heel-retaining mechanism.

A screw 28 is able to fix the counter-detent member 24 in two positions mutually offset by 180° in that it can be caused to engage with a threaded bore 29 offset to the axis *a—a* or selectively with a threaded bore 30 offset with respect thereto by 180° in relation to the axis *a—a*. The two threaded bores 29 and 30 are in a plane containing the axis *a—a* and perpendicular to the ski surface.

Figure 2:
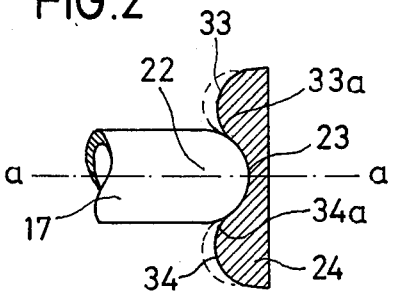
FIG. 2 is a horizontal cross-sectional view through the socket-like counter-detent member, taken perpendicularly to the plane of the drawing of FIG. 1.

The recess forming the counter-detent 23 in the counter-detent member 24 is delimited in the upward direction by a bulge-like or cam-like raised portion 31 and in the downward direction by a similar raised portion 32 whereby the raised portion 31 has a greater height—measured in the horizontal direction—in relation to a plane E—E perpendicular to the axis of rotation *a—a* and passing through the deepest point of the recess than the raised portion 32. In contrast thereto, the raised portions 33 and 34 are preferably constructed symmetrically to this axis *a—a* in a horizontal plane on both sides of the axis of rotation *a—a* (FIG. 2).

If, for example, as a result of a backward fall, a strong upwardly directed force $P_V$ occurs at the binding part 25 or at the boot sole 26, and if the binding part 25 thereby seeks to lift off from the ski in the direction of the arrow of this force, then the detent member 17 is pushed back in the direction of arrow $x_1$ by means of the inclined surface 32*a* of the raised portion 32 which delimits the counter-detent 23 in the downward direction, whereby depending on the inclination of the inclined surface 32*a* and the height of the raised portion 32, the detent member 17 is released from counter-detent 23 after a more or less large stroke or during the corresponding release forces which thereby occur at that time for the release of the binding.

In the case of lateral forces, for example, during a twisting fall, the detent member 22 is forced back by means of the inclined surfaces 33*a* or 34*a* until a release takes place in the horizontal direction by a deflection of the sole plate 25 or of the corresponding binding part. By reason of the similar construction of the raised portions 33 and 34, the binding releases in an identical manner during a right or left deflection.

If, for example, a stronger resistance with respect to a release by an upwardly directed force $P_V$ is to be produced, then the counter-detent member 24, after the screw 28 has been screwed out so far that it leaves the threaded bore 29, can be rotated by 180° in its bearing surface 24*a* so that now the raised portion 31 with the inclined surface 31*a* comes to lie at the bottom and thereby cooperates with the detent member 17 or the head 22 thereof during an upward movement of the binding part 25 in the direction of the arrow of the force $P_V$. A greater release stiffness results thereby in order to displace the detent member 17 over the raised portion 31 and to bring about the release. The dash lines over the raised portions 31 to 34 indicate merely that by an exchange of the counter-detent member 24, changed shapes of the raised portions may be provided and therewith different release characteristics may be achieved, as desired.

Instead of in conjunction with a front jaw or selectively changing with such a front jaw, the installation or the counter-detent member 24 may also be utilized in conjunction with a heel support mechanism. It may be desirable thereby, for example, to select the detent force for the use at the front jaw, on the one hand, and at the rear heel-support mechanism, on the other, different from each other and to adjust the counter-detent support correspondingly in different rotary positions.

Figure 3:
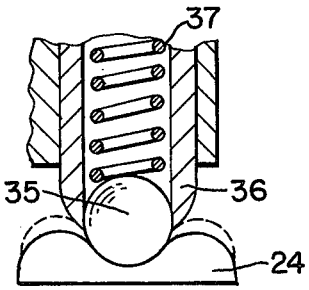
FIG. 3 is a horizontal cross-sectional view similar to FIG. 2, which shows an alternative embodiment utilizing a spring biased ball rather than a spring biased plunger of FIG. 2.

FIG. 3 shows an alternative embodiment wherein a ball 35 is provided as the locking member, this ball being guided in a sleeve 36 so that it is pressed under the force of a spring 37 against the counter-detent member 24.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What I claim is:

1. A retaining mechanism for safety ski bindings which includes a boot retaining means, a detent means a counter-detent means, a detent spring means biasing said detent means and said counter-detent means against one another, one of said detent means and counter-detent means being mounted at said boot retaining means, said detent means engaging in said counter-detent means and being operable, for the purpose of releasing the binding, to be forced out of the counter-detent means over a raised portion delimiting the counter-detent means while overcoming the detent spring force in case of strong forces acting from the ski boot on the retaining means, wherein the counter-detent means is delimited on different sides by differently shaped raised portions, the counter-detent means with the raised portions being rotatably arranged about an axis extending approximately in the direction of the detent engagement and being adapted to be secured in the preselected rotational position, said raised portion being configured to vary the forces acting from the ski boot required for release of the detent and counter-detent means in skiing use of the binding as a function of the rotational position of said counter-detent means.

2. A retaining mechanism according to claim 1 wherein the detent means includes a detent piston.

3. A retaining mechanism according to claim 1, wherein the detent means includes a detent ball.

4. A retaining mechanism according to claim 1, wherein the counter-detent means is constructed as a recess.

5. A retaining mechanism according to claim 1, wherein a counter-detent support is provided which includes the counter-detent means with the raised portions.

6. A retaining mechanism according to claim 1, wherein said axis is parallel to the direction of the detent engagement.

7. A retaining mechanism for safety ski bindings which includes a boot retaining means, a detent means, a counter-detent means, a detent spring means biasing said detent means and said counter-detent means against one another, one of said detent means and counter-detent means being mounted at said boot retaining means, said detent means engaging in said counter-detent means and being operable, for the purpose of releasing the binding, to be forced out of the counter-detent means over a raised portion delimiting the counter-detent means while overcoming the detent spring force in case of strong forces acting from the ski boot on the retaining means, wherein the counter-detent means is delimited on different sides by differently shaped raised portions, the counter-detent means with the raised portions being rotatably arranged about an axis extending approximately in the direction of the detent engagement and being adapted to be secured in the preselected rotational position, wherein a counter-detent support is provided which includes the counter-detent means with the raised portions, and wherein two differently constructed raised portions are arranged mutually opposite in relation to the axis of rotation of the counter-detent support whereas the raised portions offset by 90° with respect thereto are constructed essentially similar.

8. A retaining mechanism according to claim 7, wherein said last-mentioned raised portions are constructed identical.

9. A retaining mechanism according to claim 7, wherein the heights of the two first-mentioned raised portions are different.

10. A retaining mechanism according to claim 9, wherein the inclinations of the inner surfaces of the two first-mentioned raised portions on the detent side are differently dimensioned with respect to a plane perpendicular to at least one of the direction of the detent engagement and axis of rotation.

11. A retaining mechanism according to claim 10, wherein the rotatable counter-detent support is provided with two threaded bores and the counter-detent support is adapted to be secured on a binding part supporting the same in its two rotational positions by an axial screw selectively engaging in the one or the other of the two threaded bores.

12. A retaining mechanism according to claim 11, wherein the two threaded bores are offset by about 180° with respect to the axis of rotation of the counter-detent means.

13. A retaining mechanism according to claim 11, wherein said binding part is a sole plate.

14. A retaining mechanism according to claim 11, wherein the counter-detent support includes a rotary pin extending in the ski longitudinal direction and determining the axis of rotation, the two threaded bores being arranged in said rotary pin substantially parallel to the axis of rotation.

15. A retaining mechanism according to claim 14, wherein the two threaded bores are offset by about 180° with respect to the axis of rotation of the counter-detent means.

16. A retaining mechanism for safety ski bindings which includes a boot retaining means, a detent means, a counter-detent means, a detent spring means biasing said detent means and said counter-detent means against one another, one of said detent means and counter-detent means being mounted at said boot retaining means, said detent means engaging in said counter-detent means and being operable, for the purpose of releasing the binding, to be forced out of the counter-detent means over a raised portion delimiting the counter-detent means while overcoming the detent spring force in case of strong forces acting from the ski boot on the retaining means, wherein the counter-detent means is delimited on different sides by differently shaped raised portions, the counter-detent means with the raised portions being rotatably arranged about an axis extending approximately in the direction of the detent engagement and being adapted to be secured in the preselected rotational position, and wherein two differently constructed raised portions are arranged mutually opposite in relation to the axis of rotation of the counter-detent means whereas the raised portions offset by 90° with respect thereto are constructed essentially similar.

17. A retaining mechanism according to claim 16, wherein said last-mentioned raised portions are constructed identical.

18. A retaining mechanism according to claim 16, wherein the heights of the two first-mentioned raised portions are different.

19. A retaining mechanism according to claim 16, wherein the inclinations of the inner surfaces of the two first-mentioned raised portions on the detent side are differently dimensioned with respect to a plane perpendicular to at least one of the direction of the detent engagement and axis of rotation.

20. A retaining mechanism for safety ski bindings which includes a boot retaining means, a detent means, a counter-detent means, a detent spring means biasing said detent means and said counter-detent means against one another, one of said detent means and counter-detent means being mounted at said boot retaining means, said detent means engaging in said counter-detent means and being operable, for the purpose of releasing the binding, to be forced out of the counter-detent means over a raised portion delimiting the counter-detent means while overcoming the detent spring force in case of strong forces acting from the ski boot on the retaining means, wherein the counter-detent means is delimited on different sides by differently shaped raised portions, the counter-detent means with the raised portions being rotatably arranged about an axis extending approximately in the direction of the detent engagement and being adapted to be secured in the preselected rotational position, and wherein the rotatable counter-detent means is provided with two threaded bores and the counter-detent means is adapted to be secured on a binding part supporting the same in its two rotational positions by an axial screw selectively engaging in the one or the other of the two threaded bores.

21. A retaining mechanism according to claim 20, wherein the two threaded bores are offset by about 180° with respect to the axis of rotation of the counter-detent means.

22. A retaining mechanism for safety ski bindings which includes a boot retaining means, a detent means, a counter-detent means, a detent spring means biasing said detent means and said counter-detent means against one another, one of said detent means and counter-detent means being mounted at said boot retaining means, said detent means engaging in said counter-detent means and being operable, for the purpose of releasing the binding, to be forced out of the counter-detent means over a raised portion delimiting the counter-detent means while overcoming the detent spring force in case of strong forces acting from the ski boot on the retaining means, wherein the counter-detent means is delimited on different sides by differently shaped raised portions, the counter-detent means with the raised portions being rotatably arranged about an axis extending approximately in the direction of the detent engagement and being adapted to be secured in the preselected rotational position, wherein a counter-detent support is provided which includes the counter-detent means with the raised portions, and wherein the counter-detent support includes a rotary pin extending in the ski longitudinal direction and determining the axis of rotation, two threaded bores being arranged in said rotary pin substantially parallel to the axis of rotation.

* * * * *